US007110714B1

(12) United States Patent
Kay et al.

(10) Patent No.: US 7,110,714 B1
(45) Date of Patent: Sep. 19, 2006

(54) TELEVISION COMMERCE SYSTEM WITH PROGRAM IDENTIFIERS

(76) Inventors: Matthew W. Kay, 3 Charles Everett Way, Hingham, MA (US) 02043; Matthew J. Laughlin, 228 River St., Norwell, MA (US) 02061; Colin P. Campbell, 60 Robinwood Rd., Norwood, MA (US) 02062

( * ) Notice: Subject to any disclaimer, the term of this patent is extended or adjusted under 35 U.S.C. 154(b) by 645 days.

(21) Appl. No.: 09/704,796

(22) Filed: Nov. 3, 2000

Related U.S. Application Data

(63) Continuation-in-part of application No. 09/384,182, filed on Aug. 27, 1999.

(60) Provisional application No. 60/165,449, filed on Nov. 15, 1999.

(51) Int. Cl.
*H04H 1/00* (2006.01)

(52) U.S. Cl. ..... 455/3.02; 455/3.01; 455/158.1; 725/36; 725/136

(58) Field of Classification Search ..... 455/2.01, 455/3.06, 414.1, 77, 150.1, 426, 425, 154.1, 455/503, 186.1, 575.55, 100, 575.1, 550.1, 455/412.1, 3.02, 515, 456.5, 456.6, 158.1, 455/227, 228; 379/93.17, 67.1, 88.01, 33.12, 379/555, 14.01, 14.03, 14.05, 27, 734, 14.13, 379/231; 375/130; 348/555, 14.01, 14.03, 348/14.05, 27, 734, 14.13, 731; 370/352, 370/466, 468, 114.21, 401; 725/122, 110–112, 725/116, 131, 42, 60, 61, 11, 12, 29, 14–21, 725/32–36, 139, 22, 136; 705/8; 380/230; 386/83, 110, 111
See application file for complete search history.

(56) References Cited

U.S. PATENT DOCUMENTS

| | | | | |
|---|---|---|---|---|
| 5,421,031 | A * | 5/1995 | De Bey | 725/92 |
| 5,515,106 | A * | 5/1996 | Chaney et al. | 725/48 |
| 5,530,754 | A * | 6/1996 | Garfinkle | 725/8 |
| 5,589,892 | A * | 12/1996 | Knee et al. | 725/43 |
| 5,898,919 | A * | 4/1999 | Yuen | 455/420 |
| 5,926,205 | A * | 7/1999 | Krause et al. | 725/103 |
| 6,282,713 | B1 * | 8/2001 | Kitsukawa et al. | 725/36 |
| 6,438,751 | B1 * | 8/2002 | Voyticky et al. | 725/42 |
| 6,615,408 | B1 * | 9/2003 | Kaiser et al. | 725/112 |
| 2004/0049792 | A1 * | 3/2004 | Yurt et al. | 725/86 |

* cited by examiner

*Primary Examiner*—Edward F. Urban
*Assistant Examiner*—Charles Chow
(74) *Attorney, Agent, or Firm*—Antonelli, Terry, Stout & Kraus, LLP

(57) ABSTRACT

A commerce control network is provided for obtaining product information and for purchasing products through a two-way interactive broadcast distribution system, such as a cable or satellite television system. The network includes advanced television set top boxes that provide users with the ability to access product information through the system. A unique identifier is received with the program being viewed and included in the user's request for product information to assure that the information retrieved from the network is timely and related to that program.

47 Claims, 11 Drawing Sheets

TELEVISION COMMERCE SYSTEM WITH PROGRAM IDENTIFIERS

RELATIONSHIP TO OTHER APPLICATIONS

This application is a continuation-in-part of pending application Ser. No. 09/384,182 filed on Aug. 27, 1999, and includes the disclosure of provisional Application Ser. No. 60/165,449 filed on Nov. 15, 1999.

FIELD OF THE INVENTION

This invention relates generally to an interactive television commerce system, and in particular, to the use of program identifiers to properly synchronize a viewer's receipt of product related information with the programming to which it is related.

BACKGROUND OF THE INVENTION

The Internet is growing rapidly and has emerged as a significant interactive medium for entertainment, communications, research, education and e-commerce. However, Internet access generally requires a personal computer, and some consumers may have little need or desire for a personal computer, either because it can be costly, or because it can be difficult or complicated to use. For such consumers, it may be preferable to receive electronic information and entertainment services through their television sets. A television-based approach to e-commerce would appear to be an attractive alternative for many of these consumers.

Interactive television is developing rapidly and permits the viewer to participate in a wide range of activities, such as information retrieval, video games, and purchasing of goods and services. In a traditional cable or satellite television system, a set top box receives multiple channels of programming content from a cable or satellite television operator, and transmits to the television receiver the specific programming content on a channel selected by the viewer. The transmission of information occurs in one direction only, from the cable operator, via the set top box, to the television receiver for viewing by the viewer. In an interactive television system, by contrast, the set top box also functions as an intelligent communications terminal, and is able to store and run application programs that permit two-way communications between the viewer and the cable operator to support a wide variety of interactive functions.

Cable television system operators, referred to here as multiple system operators (MSO), are currently deploying digital broadband delivery systems (DBDS's) capable of supporting interactive television commerce. The terminology used here is essentially that of Scientific-Atlanta, Inc., but the components described could be used in other systems. DBDS allows the MSOs to offer their subscribers digital content that looks better than cable transmitted analog programs, and allows more digital channels to run on the same cable wire (at least 8 times as many). DBDS also offers two-way messaging between the cable network and set top boxes, allowing MSOs to offer customers interactive applications such as near video on demand and email. DBDS is designed as a client server network with client applications running on set top boxes that communicate with an application server that provides the content for the client applications.

DBDS has several components that work together to deliver these broadband digital services to consumers. Analog set top boxes are replaced by digital set top boxes, referred to as digital home communications terminals (DHCTs). A DHCT is essentially a small network computer that provides a subscriber with the ability to run multiple applications. It also provides Internet protocol (IP) connectivity back to a server via a hybrid fiber coax (HFC) line wired to the subscriber's home to allow an application running on the DHCT to interact with the DBDS.

A digital network control system (DNCS) is a server, typically UNIX based, that controls the configuration of the entire DBDS, routine DBDS maintenance, SNMP monitoring, the broadcasting of data to the set tops, and the registering of additional applications that run on the DBDS. One DNCS can currently handle up to two hundred thousand subscribers.

A broadcast file system (BFS) is a component of the DNCS and is essentially a file system containing system data (such as DHCT configurations) and application data. This file system is continuously broadcast in a carousel fashion over the DBDS via an in-band data path (IDP) and an out-of-band data path (ODP). DHCTs can then access the BFS in much the same way that a PC accesses a hard drive.

The IDP is a 27 Mbps data channel that the DHCTs tune to, much like any other programming channel. The path is physically provided by a broadband integrated gateway (BIG) and an in-band quadrature amplitude modulator (QAM). In essence, these pieces of hardware are employed to create a 27 Mbps path over which the BFS is continuously broadcast to the DHCTs. Once the DHCT is tuned to the data channel, it can read the BFS data carousel at this high speed. This is useful for loading a new application on the DHCT as well as in any situation where fast access to the BFS is required. The IDP is one-way; no programming content can be received while the IDP data is being read.

The ODP is a data channel that can be accessed while programming content is being sent to the DHCT. The two components that make up the ODP are a forward data channel (FDC) that broadcasts out to the DHCTs and a reverse data channel (RDC) that receives data from the DHCTs, both at T1 speed. The FDC interface to the HFC is provided by a quaternary phase shift key (QPSK) modulator. The RDC interface to the HFC is provided by a QPSK demodulator. In essence, this equipment functions as a modem to bridge the HEC to an Ethernet component of the DBDS. The FDC and RDC are used by server applications to communicate with the DHCTs.

Cable head end application servers reside on the same IP network as the DNCS, and provide a hardware platform for running server based software applications that will be provisioned to the DHCTs, such as near video on demand and email. Services that run in the DBDS have a component running on the application server and are registered with the DNCS.

While it is common on television to provide informational messages to viewers independently of any programming content, such as in the case of severe whether warnings, it is more useful and beneficial, particularly where the informational message is intended to elicit a response, to be able to have such message displayed in conjunction with the particular program to which the message relates. For example, a viewer may be given the opportunity to register his or her assessment of the television program being viewed, to indicate his her desire to receive marketing or promotional materials or samples of a particular product or service being advertised on that program, or even to purchase such products and services. Viewing the information message in conjunction with a related program creates a sense of immediacy or urgency that increases the likelihood of the viewer responding to the message.

In such a system, it is critical that the informational messages be available for display to the viewer at the appropriate point within the associated program. If, for example, the intention is to solicit the viewer's interest in receiving a glossy brochure on a particular automobile during a commercial for that same automobile, then it is important that this message be available only during the typical 30-second duration of such a commercial. Receiving the message before the commercial might confuse or even irritate the viewer, since it would not be clear why the apparently unrelated message is being displayed. Conversely, if the message appears after the commercial has ended and the sleek, gleaming vehicle is no longer visible on the screen, the viewer's excitement and interest in the vehicle might have already faded.

Although it is possible to use pre-existing program schedule information, including time and channel, to establish a relationship between a viewer's request for information and the programming being viewed at the time of the request, such an approach is subject to schedule errors and unforeseen schedule changes. Often, precise schedules of commercial messages are simply not available to third-party television commerce service providers.

What is needed is a system for providing interactive e-commerce on a television distribution network, that can reliably synchronize the delivery of product related information to the programming to which the information is related. The system should provide notification to the viewer in a timely manner of the availability of such information, respond promptly to user requests for the information, and avoid reliance on program schedule information, such as time or channel, in order to correctly retrieve the desired product information for the user.

OBJECTIVES

Therefore, it is an objective of the present invention to provide a system for making available product related information that is synchronized with a related television program.

It is another objective of the present invention to ensure that viewers are timely notified while viewing television programming of the availability of related product information.

It is a further objective of the present invention to facilitate prompt and correct responses to viewer requests for product related information. It is yet a further objective of the present invention to synchronize the provision of product related information to its associated programming in a manner that accomodates errors and unexpected changes in program schedule.

The above objectives, as well as other objectives, features and advantages of the present invention will become readily apparent from the following detailed description, which is to be read in conjunction with the appended drawings.

SUMMARY OF THE INVENTION

The present invention includes a commerce control network (CCN) system and methods for obtaining product information and for purchasing products through a two-way interactive television system.

In one aspect, the invention includes a three.-tier architecture that has client applications residing in individual set top boxes; a commerce transfer point (CTP), including at least one commerce application server (CAS) and at least one head end database server (HEDS); and a remote commerce control point (CCP) coupled to one or more CTPs. The commerce application server communicates between the client applications and the HEDS, which stores commerce control network data such as product, user and broadcast information. The HEDS communicates with the CCP to transfer commerce control network data back and forth. The CCP would typically be coupled to a number of HEDS, and the data in each HEDS would be periodically replicated in the CCP.

According to another aspect of the invention, user requests for information are categorized either as high priority requests or as low priority requests, and placed in separate queues at each HEDS, which is the network server that preferably handles such requests. Use of multiple queues helps make possible the processing a large number of use requests that may occur at the same time in response to a particular program segment. The high priority queue is preferably a real-time queue, while the low priority queue may be a batch queue.

In another aspect, the system of the present invention can provide product information or a purchase screen for a list of products in a manner related to underlying broadcast programming content. The product information can be provided to the user in response to a user input. For example, a user can press a certain key on a television remote control upon seeing an icon during programming and access a simple electronic buying guide that displays to the user a list of products that are related to that programming. The information that is displayed may be on a translucent screen, on a screen that blocks part of the programming, or on a full screen.

By using the remote control, the user can also enter a more comprehensive electronic buying guide. This electronic buying guide preferably has a scrollable list of items, a detail window that provides detailed information about the attributes of an item in the list that the user has selected, and a video window that captures the programming, all displayed at the same time.

In another aspect, the system of the present invention allows the user to select an item from a displayed list of products and store it in a server (such as in the HEDS) in a list that is personalized for the particular user and accessible so the personalized list can be retrieved at a later time by the user. This accessible and personalized list in essence functions as a persistent shopping cart containing the user's favorite items.

In accordance with another aspect of the invention, the icon displayed with the video programming, to indicate that commerce related information is available on the tuned channel, can be triggered by data received with the broadcast programming, so as to be simultaneously displayed with a predetermined portion of the programming. When the user makes an input in response to the icon, further commerce related information is accessed by the system and broadcast to the user.

In a further aspect of the invention, video programming is broadcast with a plurality of program identifiers, each program identifier being uniquely associated with a particular segment of the video programming. The set top box at each user station, receives each video programming segment with its unique identifier and can, preferably in response to a user input, transmit a request, containing the unique identifier, to the broadcast station from which the video programming was broadcast. Typically, the broadcast station is at the head end of a cable television distribution system.

The broadcast station uses the unique identifier included in the product related request to retrieve product related data from a database associated with a system server, also typically located at the head end in a cable television system. By using the unique program identifier included in the user's request, the system can correctly retrieve the product related data intended for the program segment being displayed to the user, without the need to use program schedule information, such as time and tuned channel, and therefore, unaffected by program schedule errors or changes.

The unique program identifier can also be used by the set-top box, when received at the user station, to trigger the display of an icon to notify the user of availability of product related data associated with the programming segment then being viewed. Based on the first product related data received, preferably a listing of available products, the user can interact with the system to obtain detailed information about the attributes of selected products, or to purchase products, associated with the programming content, in the manner discussed above.

The system of the present invention may be used in a widely available television network, such as a cable television system or a satellite television system available over a wide area and to a very large number of users. The system of the present invention is simple to operate, in that it is completely functional from a television remote control, and it provides enhancements to the traditional broadcast entertainment programming currently available through cable and satellite operators.

DETAILED DESCRIPTION

Figure 1:
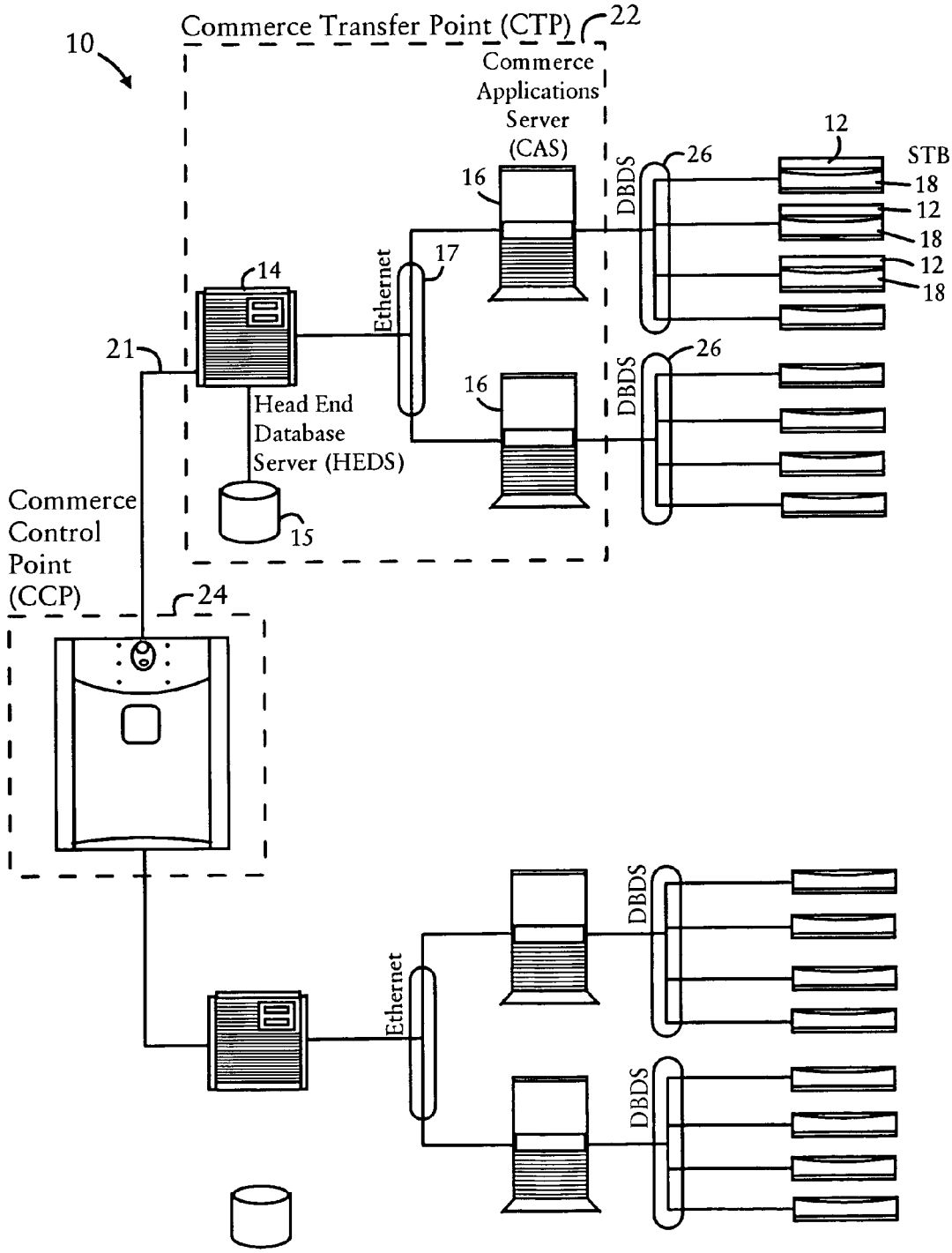
FIG. 1 is a block diagram of a commerce control network according to the present invention.

Referring to FIG. 1, the present invention includes an interactive television commerce system, referred to as a commerce control network (CCN) 10, in an interactive television system, such a cable television system described above or a satellite television system, that is widely available to a large number of users, e.g., over a metropolitan area. CCN 10 allows TV users to select, purchase, gain additional information about, and store information relating to products using a simple and convenient menu-based user interface. The system can provide product lists that may or may not be customized based on a particular channel and/or program being watched, or the product lists or other information can be tailored for the individual user.

In one instance of the system, if a user orders a product, the order can be processed by the system, the user's credit card may be billed, inventory may be updated, and the order may then be forwarded to a warehouse for shipment. In another instance, if a user orders a product, the order can be processed by the system and then forwarded to an appropriate third-party vendor for billing and fulfillment. In the latter instance, periodic status updates on the order may be provided by the vender to the system. The system, referred to here as an electronic buying guide (EBG), is not strictly limited to "buying," but can also include obtaining product information and samples.

CCN 10 of the present invention has a three-tiered architecture with client applications 12; a commerce transfer point (CTP) 22, and a commerce control point (CCP) 24.

Figure 8:
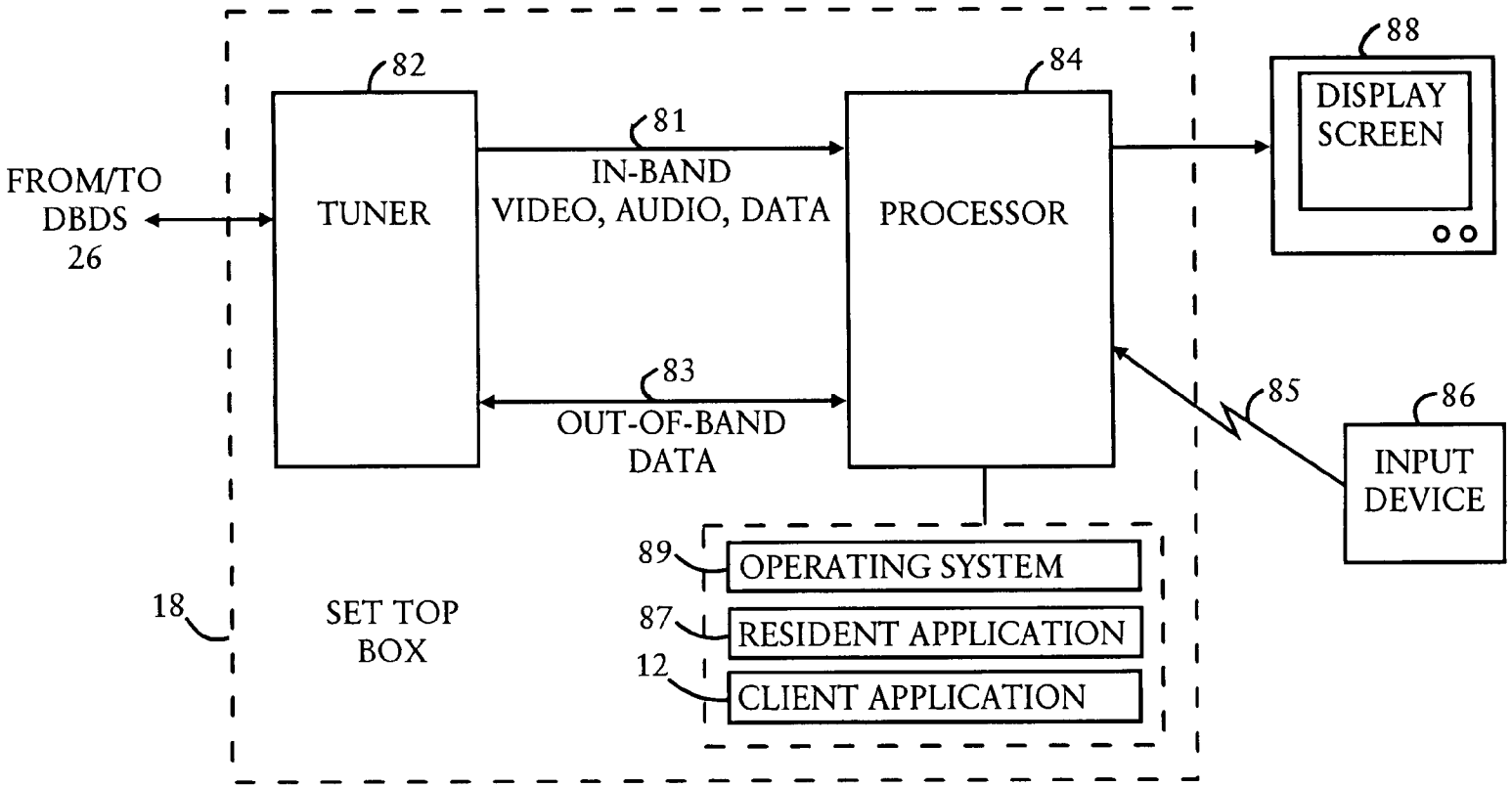
FIG. 8 is a functional block diagram of a set top box and other items comprising a typical user station.

FIG. 8 shows a functional block diagram of a set top box 18, and other items comprising a typical user station in the commerce control network 10 of FIG. 1. Client application 12 runs on processor 84 under a set top operating system (OS) 89, such as the PowerTV Set Top OS, which is currently being provided with a Scientific-Atlanta DHCT, or under a Windows CE OS. In the case of the PowerTV OS, client application 12 may be created using a PowerTV development kit. The PowerTV OS provides a full-featured application programming interface (API) that allows a developer to isolate the application code from the hardware level of the set top box.

Client application 12 provides the user with a convenient user interface that is controllable by the user with an input device 86, preferably a standard STB remote control, to allow viewing, purchasing, or obtaining information about products. The input device may be connected to STB 18 directly or, more typically, by infrared link 85. The viewer can thus conveniently access the application via a remote control button while watching television.

As will be explained in further detail below, client application 12 directs the display of product related information on a display screen 88, usually a standard television set, and can do so simultaneously with display of the programming to which STB 18 is tuned. A tuner 82 can be tuned to a multiplicity of broadcast channels on a broadcast distribution network (DBDS) 26 to receive in-band video, audio and data 81, for display to the user.

The functionality to call the client application is built into a resident application 87 that runs on STB 18 and can be provided by a variety of third party vendors. A client application executable is loaded onto STB 18 from broadcast distribution network (DBDS) 26 when resident application 87 determines that the user has tuned to a channel that is configured to run the client application.

In addition to in-band path 81, tuner 82 also provides a bi-directional out-of-band data path 83 over which processor 84 sends product related requests, generated in response to user inputs, to CTP 22, and over which processor 84 can receive product related data from CTP 22.

The term "set top box" is meant broadly to include a processing functionality with a television set; that functionality could be integrated into the television set itself, for example, and thus need not be literally in a separate standalone "box."

Again with reference to FIG. 1, CTP 22 includes one or more commerce application servers (CAS) 16, each in communication with a number of set top boxes; one or more head end database servers (HEDS) 14, each connected to one or more CASs; a private Ethernet network for connecting CASs and HEDSs; and a private wide-area network connection 21 for communication with CCP 24. CTP 22 handles all of the requests from the client applications 12, and serves as a data conduit to CCP 24. In the case of a cable television system, the CTP is preferably located at the cable head end.

CAS 16 is responsible for registering CTP 22 for use within the DCN of the local MSO, and for providing client application 12 to DBDS 26 for distribution to set top boxes 18. The CAS also serves as the point of communication between client applications 12 and HEDS 14, and thus CAS 16 handles all client application 12 requests and forwards them to HEDS 14. The number of CAS 16 machines may be set as needed based on the number of STBs 18.

CAS 16 is preferably implemented by a small server, such as a Compaq Proliant Model 1600R running Windows NT, preferably with message queuing software such as Microsoft Message Queue (MSMQ). CAS 16 utilizes at least one Ethernet card to access HEDS 14 and at least one asynchronous transfer mode (ATM) card to access DBDS 26 via an ATM switch, such as a Xylan ATM switch. The system can have one more CAS 16 than is needed to handle usage so that in the event of a failure of one CAS, the overall system will still handle the full processing load.

Figure 2:
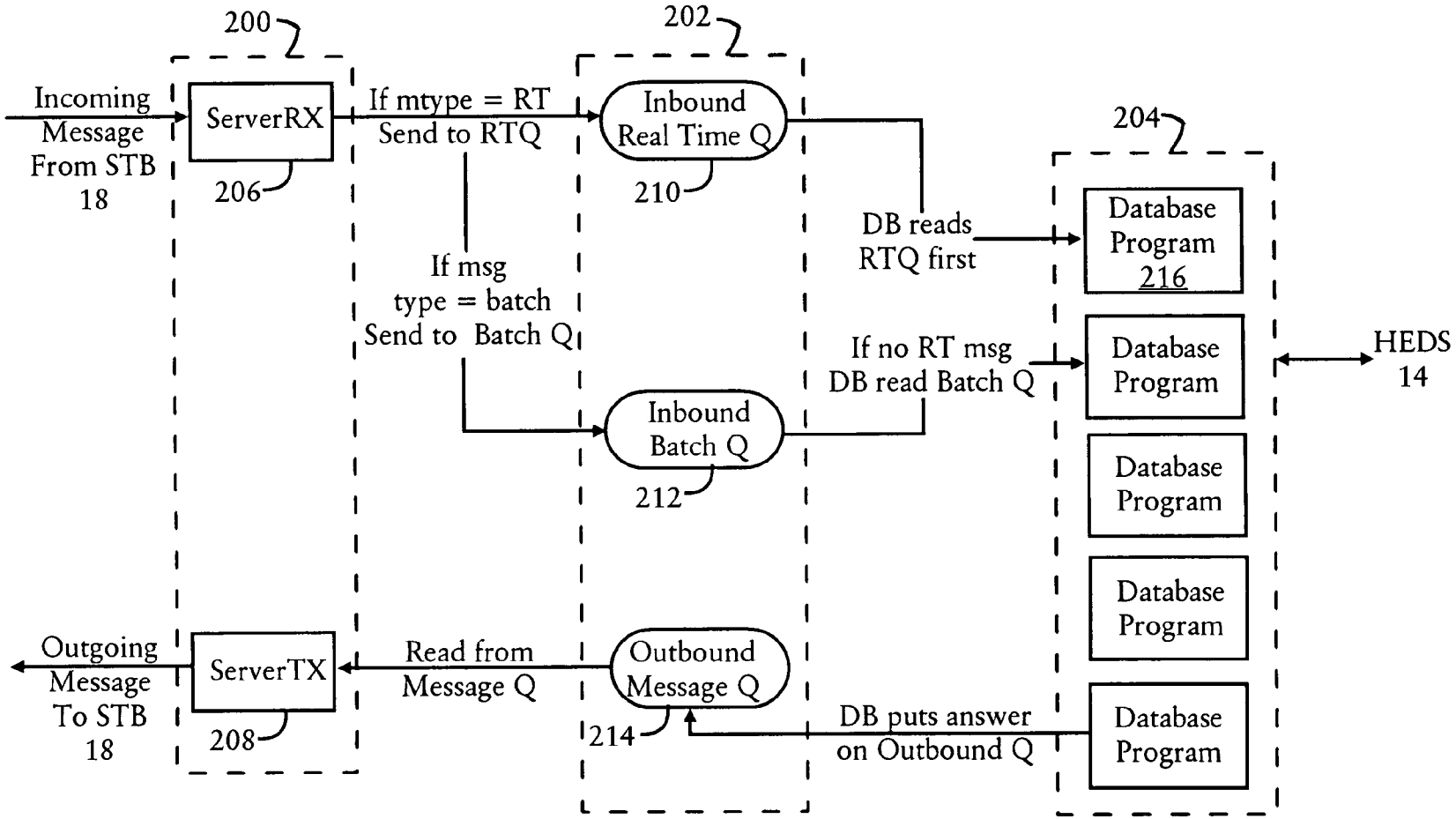
FIG. 2 is a software process diagram of the commerce applications server.

Referring to FIG. 2, CAS 16 has three components implemented in software, socket server process 200, which manages the client TCP/IP connections; message queuing component 202, which provides the message queuing functionality; and database process 204, which processes client requests and provides database access.

Socket server process 200 has at least two functions: a receive service, ServerRX 206, and a transmit service, ServerTX 208. ServerRX 206 manages client connections from a number of client applications 12, reads the client requests, and puts each such request message in an appropriate inbound queue in message queuing component 202 based on header information contained in the request. ServerTX 208 scans the outbound queue of message queuing component 202 for replies from the database, opens connections to the appropriate client applications 12, and forwards the replies to the clients.

Message queuing component 202 is preferably implemented as multiple queues. For ServerRX 206 communications, there are at least two queues: inbound real time queue (IRTQ) 210 and inbound batch queue (IBQ) 212. The request messages from the client applications have header information that indicates the response priority. A client application request whose header information indicates that the request requires an immediate answer will be placed in the real time queue 210. A client application request whose header information indicates that the request does not require an immediate answer will be placed in the batch queue 212.

Database process 204 has a number of single database programs 216, each of which can service incoming client application requests from message queuing component 202. Each database program 216 processes one inbound request from message queuing component 202 at a time. Each database program 216 first processes requests in IRTQ 210. If IRTQ 210 is empty, each database program 216 processes requests in IBQ 212. Database program 216 can then submit a request to the associated HEDS 14 and wait for a reply. When a reply is received, database program 216 forwards that reply to outbound message queue (OMQ) 214. Messages are retrieved from OMQ 214 by ServerTX 208, which functions as described above.

The use of these multiple queues and database programs helps make possible the processing of a large number of requests by users through their client applications at the same time.

Referring again to FIG. 1, each CTP 22 contains at least one HEDS 14 to provide all persistent data storage, including customer information, order status, program data, item information, and item descriptions. HEDS 14 is preferably implemented by a small server, such as a Sun Sparc 1 running Solaris or an IBM R56000 Model C20 running AIX, and preferably with a relational database management system (RDBMS) 15, such as an Oracle RDBMS. The use of an RDBMS is desirable because an RDBMS allows for scalable access to large amounts of data. HEDS 14 preferably has at least one Ethernet card to communicate with one or more CASs 16 via a private Ethernet network 17 and at least one Ethernet card to communicate with CCP 24 via wide-area network 21. HEDS 14 also has a console for either local or remote maintenance and operation.

Figure 3:
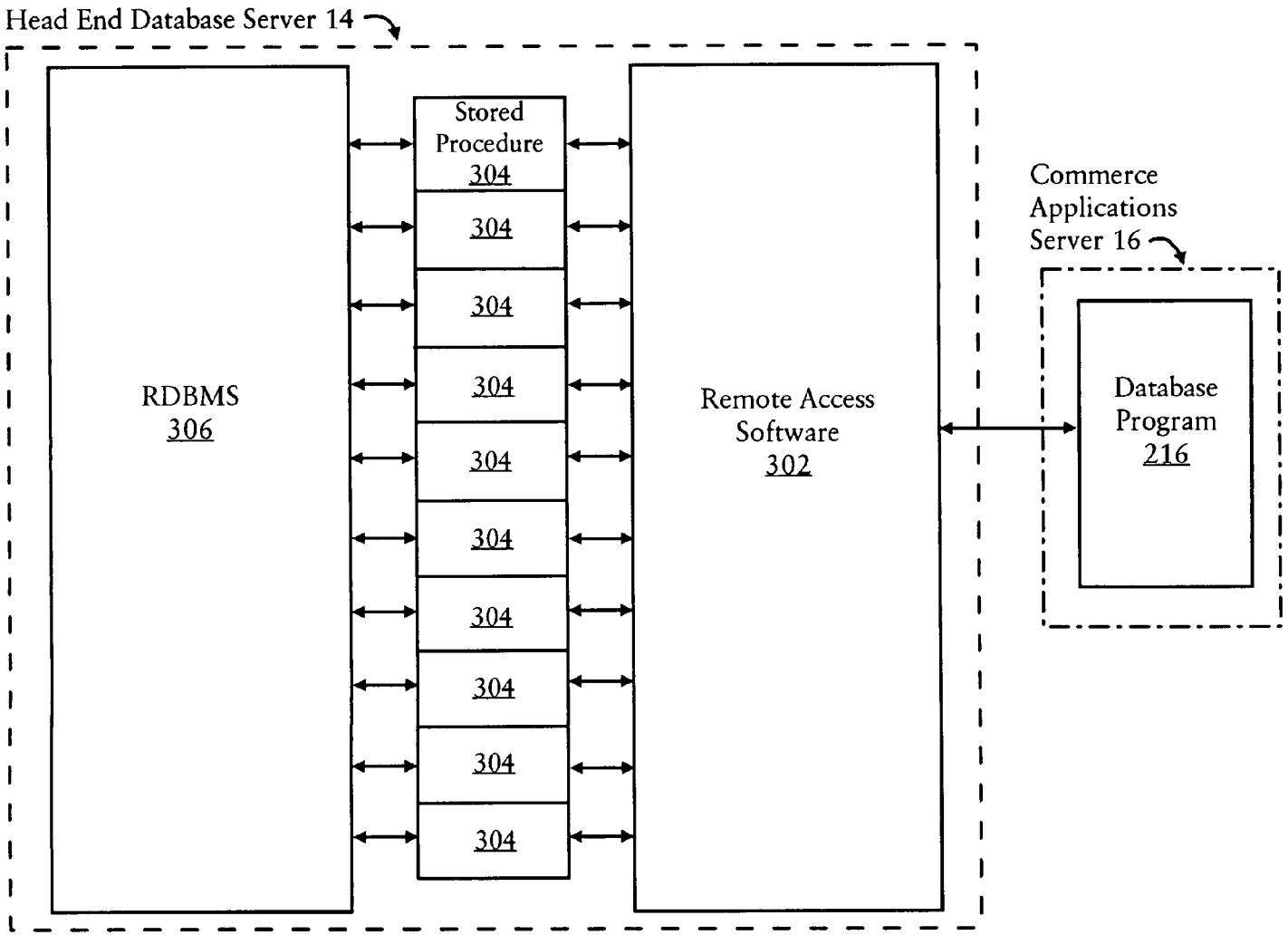
FIG. 3 is a software process diagram of a head end database server.

Referring to FIG. 3, database program 216 submits requests to HEDS 14 via remote access software 302, such as Oracle SQL*NET. The requests include information for directing HEDS 14 to execute any one of a number of stored procedures 304 on RDBMS data. Stored procedures 304 contain the business logic for supporting certain applications in the network, such as an electronic buying guide application and a quick buy application (discussed below).

RDBMS data is populated by multiple sources. These sources include CCP 24, which can provide data such as broadcast schedules, product lists, product information and order status information; CAS 16, which provides data from user inputs such as credit card data, pass codes, multiple user profiles and specific transaction information; and an MSO billing system, which provides household specific information including name, address, telephone number, and an unique identifier for a user's STB.

HEDS 14 combines specific transaction information with credit card information and household specific information and forwards the combined information to CCP 24 in a real time or in near real-time fashion periodically at some desired time, which may be different for different types of information (e.g., general requests for information may be transferred at a slower rate than orders from customers to purchase products). The CCP thus replicates what is in the different HEDSs in communication with it. HEDS 14 also monitors portions of the system to ensure proper operation and generates alarms to CCP 24 when problems are detected.

Figure 4:
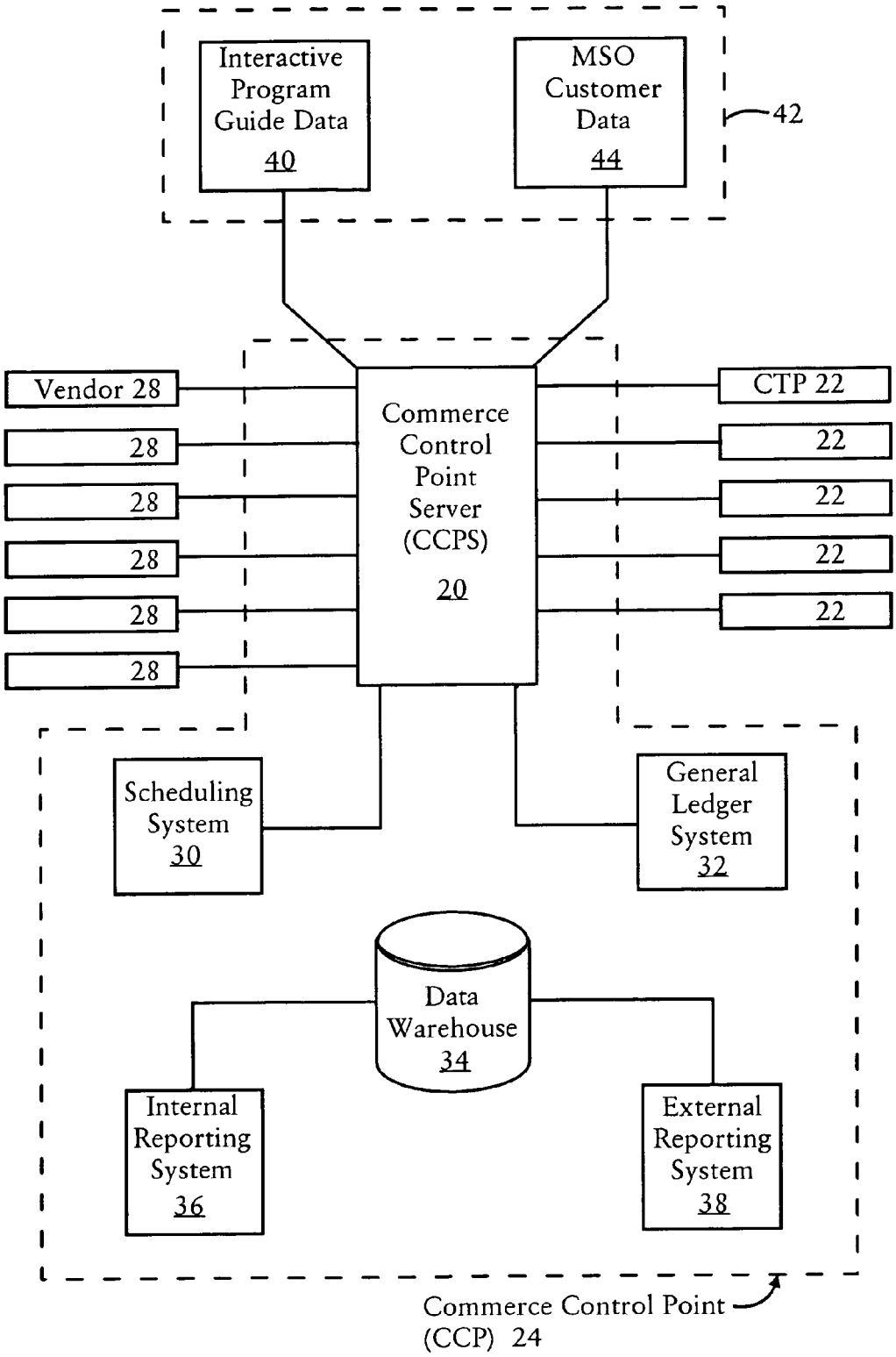
FIG. 4 is a block diagram of a commerce control point.
Figure 5A:
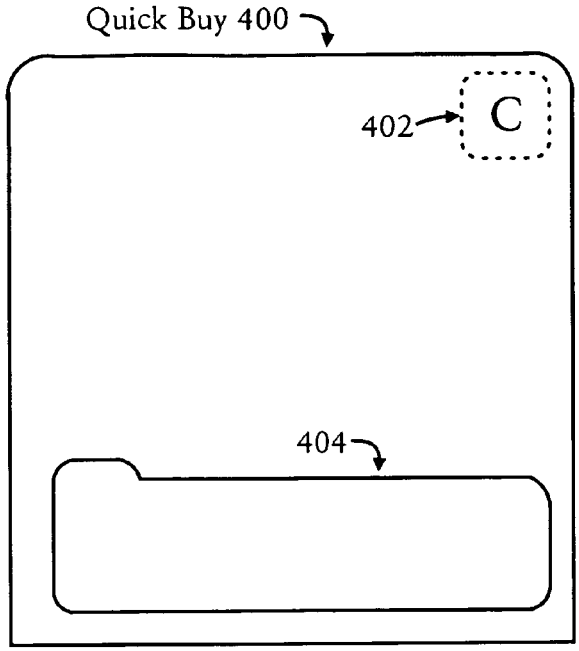
FIGS. 5(*a*)–5(*d*) are block diagrams of screen shots and portions of screen shots for the quick buy client application.
Figure 5B:
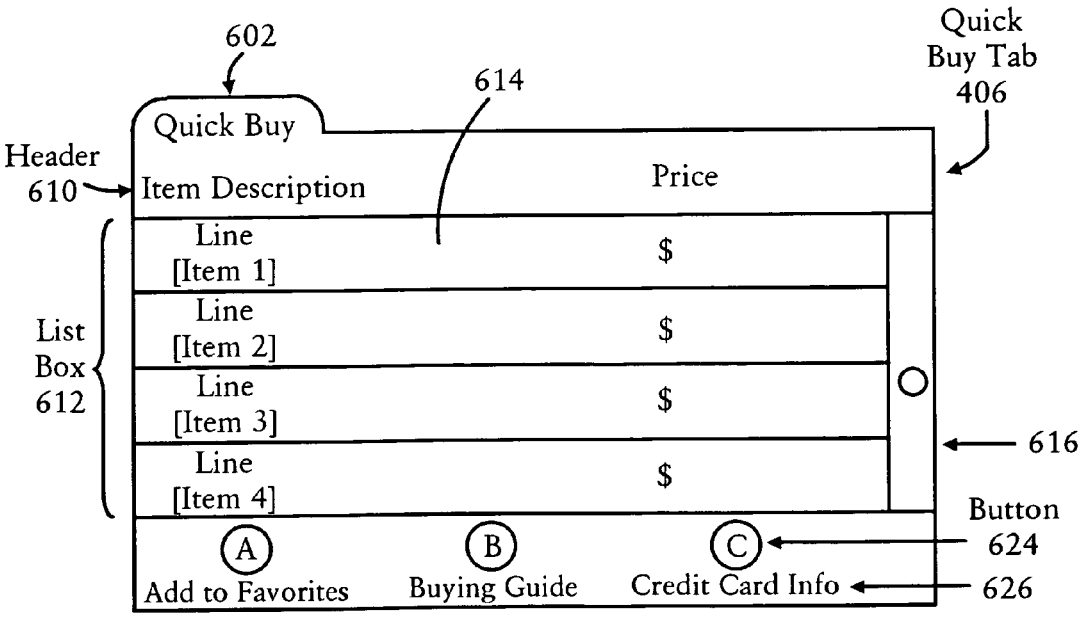
Figure 5C:
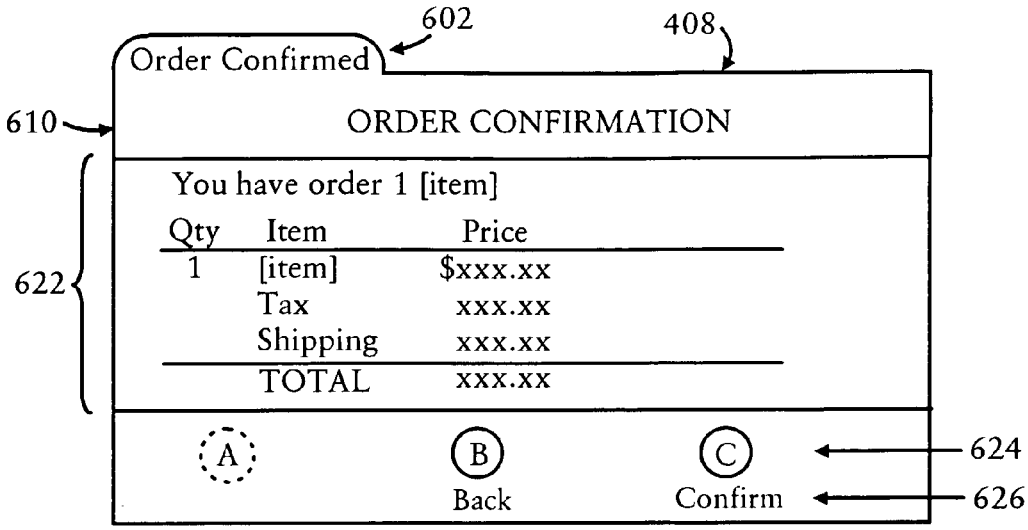
Figure 5D:
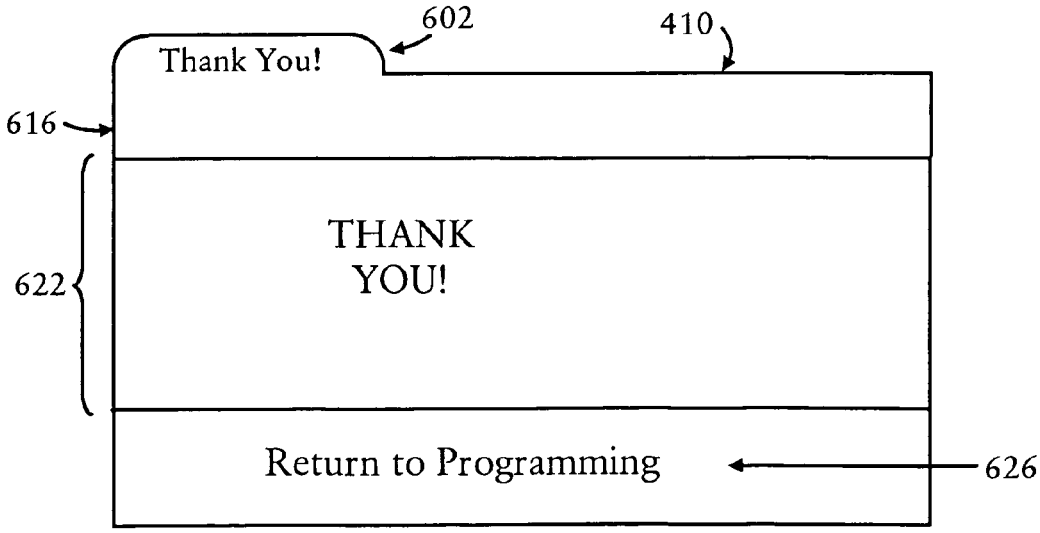
Figure 6A:
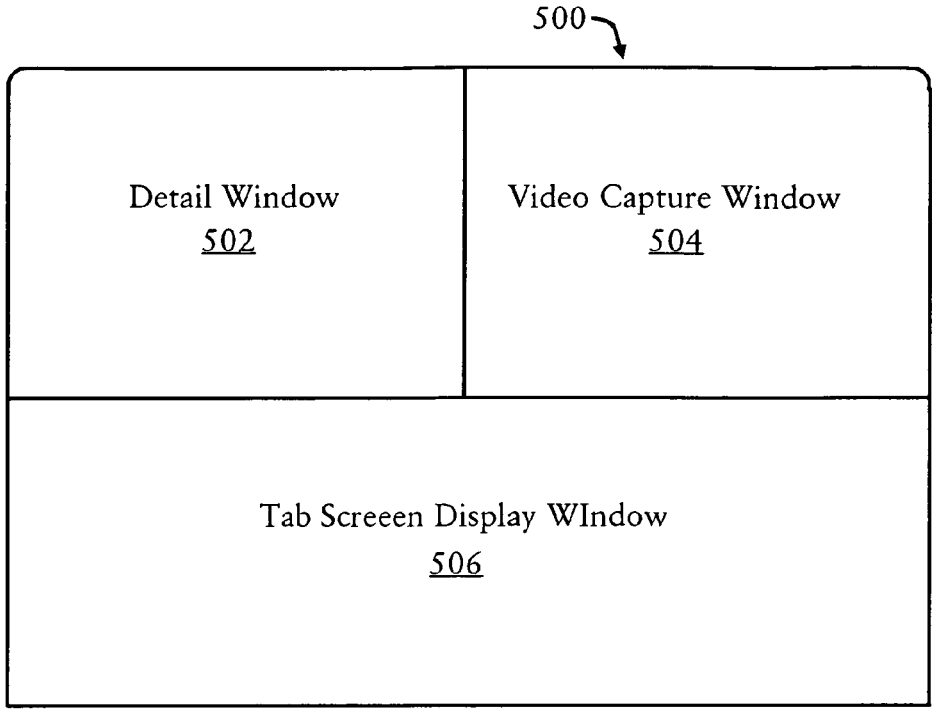
FIGS. 6(*a*)–6(*f*) are block diagrams of screen shots and portions of screen shots for the electronic buying guide application.
Figure 6B:
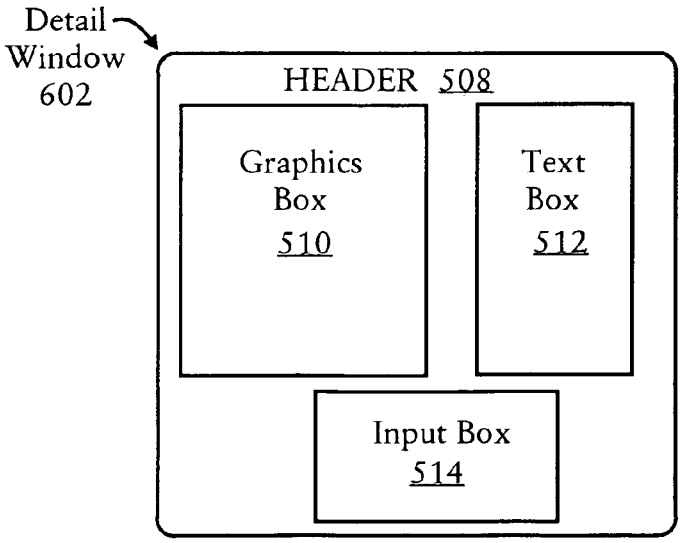
Figure 6C:
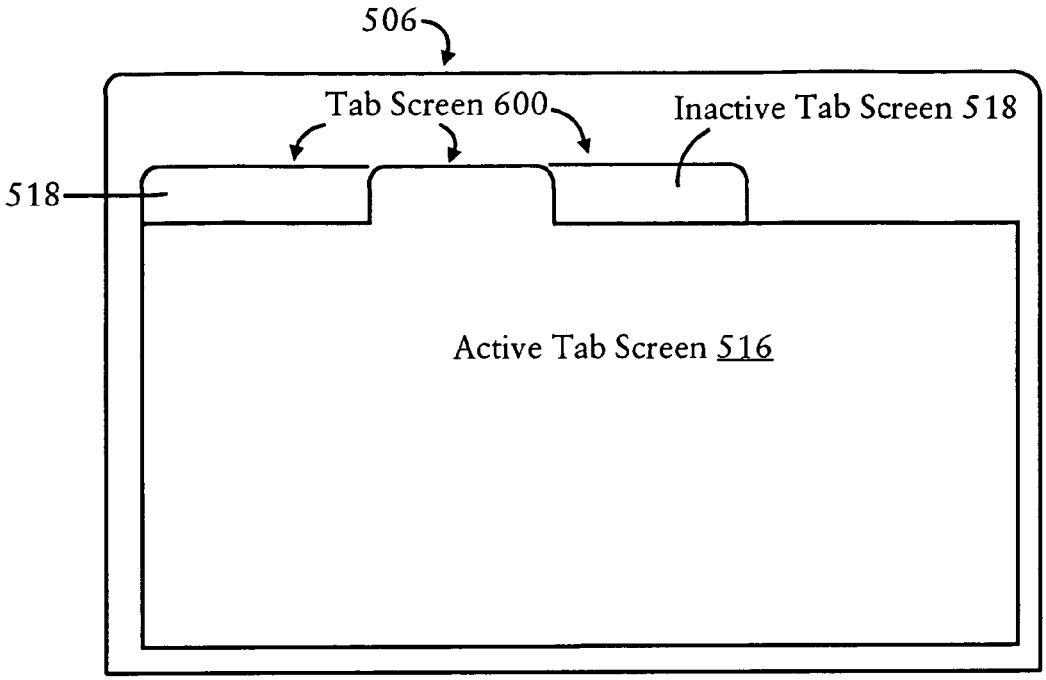
Figure 6D:
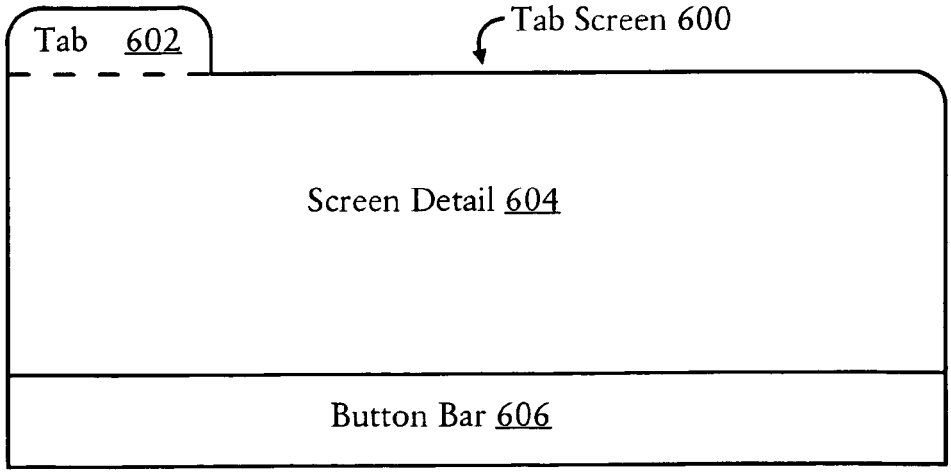
Figure 6E:
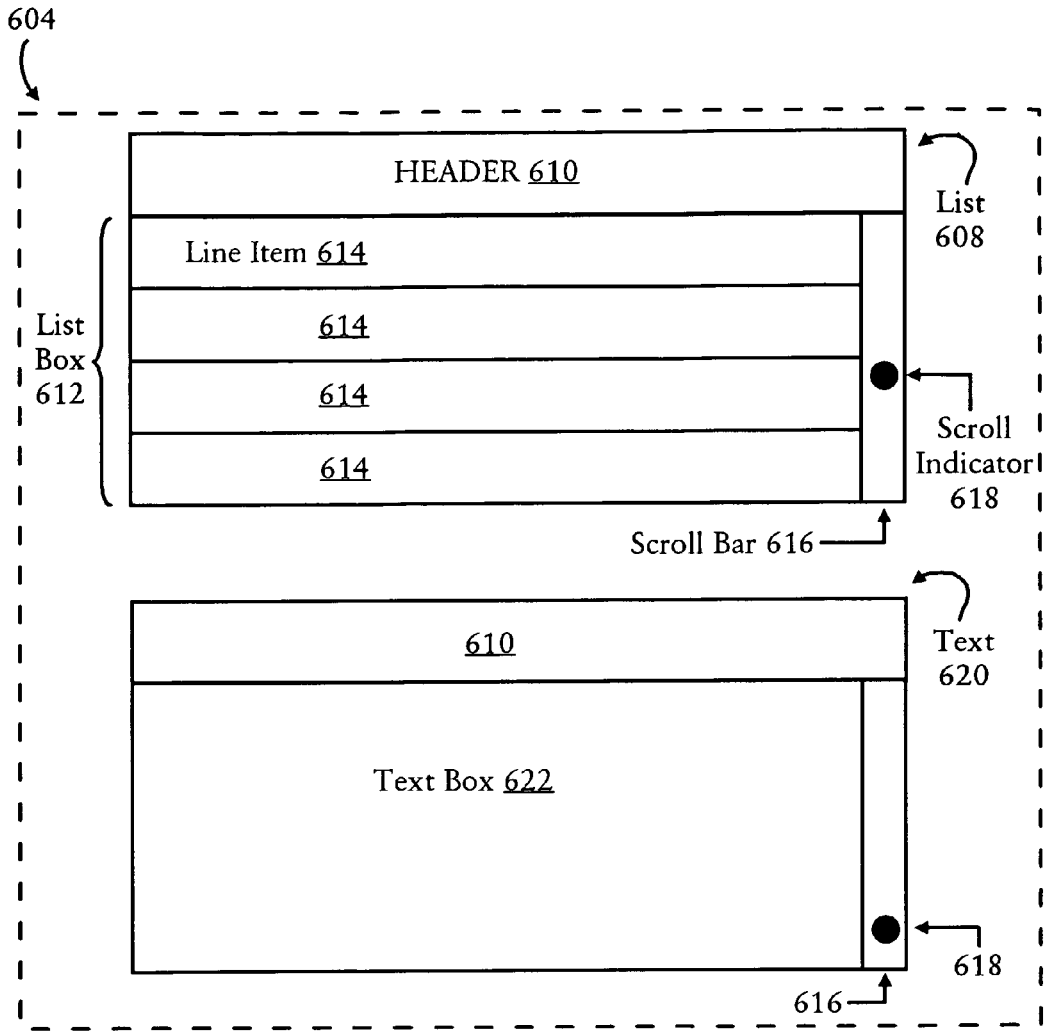
Figure 6F:
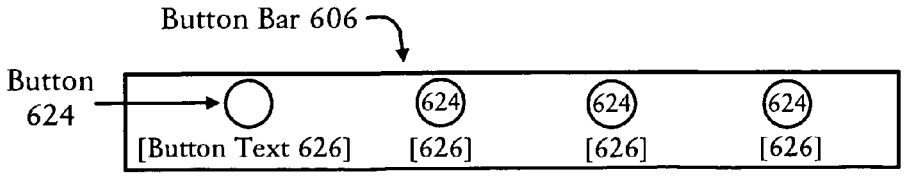

Referring to FIG. 4, commerce control point (CCP) 24 preferably includes at least one of each of the following components: a CCP server 20, a scheduling system 30, a general ledger system 32, a data warehouse 34, an internal reporting system 36 and an external reporting system 38. CCP server 20 can be a large, highly available UNIX based server with a separate disk farm and an RDBMS. Scheduling system 30 can be a UNIX based server with an RDBMS. General ledger system 32 can be a component of a standard accounting system software package. Data warehouse 34 can be a large UNIX based server with a separate disk farm and an RDBMS. Each reporting system can be a Windows NT workstation. CCP 24 may reside at a dedicated location or locations such as a collocation area of a telephone company central office or point of presence. CCP 24 also performs various maintenance and monitoring functions on its own systems to alert operators when any problems are detected.

CCP server 20 communicates bi-directionally with one or more commerce transfer points (CTPs) 22 and provides data, including broadcast schedules, product lists, product information and order status information, to each such CTPs 22. CCP server 20 also aggregates user data in order to create user profiles. These user profiles can be compared to a stored product list and then used to allow a product lists to be customized for groups of users or for each individual user, or to associate one of a number of product lists to each user.

CCP server 20 interfaces with vendor e-commerce systems 28 to forward sales orders, obtain inventory control information, authorize and settle credit card transactions, and provide order fulfillment. CCP server 20 can have a number of external data feeds 42. In the preferred embodiment, these feeds include an interactive program guide (IPG) data 40, which provides raw broadcast schedules, and MSO customer data 44, which provides the customer name, address and phone number associated with a unique set top box identifier.

Scheduling system 30 receives IPG data 40 and raw vendor product lists from CCP server 20, and provides to vendors a web-based interface for each vendor to designate which products from such vendor's raw product list are to be associated with which programming. The scheduling system then forwards the configured information back to CCP server 20, which in turn forwards the configured information to the appropriate CTPs 22.

General ledger system 32 can record all of the commerce control network's billable transactions downloaded from the CCP servers 20, and then can aggregate transaction information on a vendor-by-vendor basis for invoicing and financial reporting. Ledger system 32 can perform a similar function for other network participants such as MSOs.

Data warehouse 34 stores a near real time image of all of the data resident in each of the CCP servers 20. This data is used by internal reporting system 36 and external reporting system 38 to generate detailed reports without using the processing resources of the CCP server. Internal reporting system 36 generates reports relevant to the operation of the CCN, such as exception reports and CCN marketing reports. External reporting system 38 generates reports configured in any reasonable manner deemed useful by vendors or other CCN participants, such as vendor sales and demographics reports.

Referring to FIGS. 5(*a*)–5(*d*) in general, one embodiment of client application 12 is a quick buy application (QB) 400. Referring particularly to FIG. 5(*a*), when the user tunes STB 18 to a certain channel which has been pre-configured to function with the QB 400, STB 18 resident application responds by loading the QB 400 executable file from the MSO's head end network file system (such as the Scientific Atlanta broadcast file system). Once loaded and running in the memory of a STB 18, QB 400 displays the video and audio portions of the tuned channel and can display a quick buy icon 402 indicating that the tuned channel is QB 400 enabled. In the preferred embodiment, the icon is static; however, it could also be a dynamic mix of graphics and text, and it can be flashed at certain times to encourage the user to enter a purchasing mode.

The presence of quick buy icon 402 informs the user that QB 400 is running and therefore that the user may enter a purchasing and product information mode by pressing a defined key on the user's remote control. In an alternative embodiment, the user may enter a purchasing mode by pressing a defined key on the STB remote control even when the icon is not present to enter QB.

Once the user enters the purchasing mode, QB 400 sends a client request to commerce transfer point (CTP) 22, which processes the request as described above and sends a database reply containing the list of product information associated with the tuned channel and current time, i.e., the programming. Alternatively, CTP 22 can send a database reply with a list of products or product information that may be tailored to that user, or may be general product information provided to all users.

Referring to FIG. 5(*b*), QB 400 displays a tab screen 600 containing a product list and certain product information, such as prices for each of the items. A possible embodiment of the tab screen 600 displayed by QB 400 could be configured as shown in quick buy tab 406. Quick buy tab 406 may be translucent and overlays a portion of the video of the tuned channel. When quick buy tab 406 is displayed, QB 400 can remove the quick buy icon, if any, from the television screen.

The user can use standard tab screen navigation techniques (described below) to select a line item 614 from a list box 612 by pressing a defined key on the user's STB 18 remote control. The user may select a line item 614 for one of a number of purposes indicated by buttons 624 and button text 626. By selecting one button, the item can be saved into a customized and personalized list (referred to here as a "Favorites" list) that is stored in the CTP, such that the personalized list can be accessed at another time. By selecting another button, the user can enter the electronic buying guide discussed below. By selecting yet another button, the user can indicate a desire to purchase at the current time and then enter a credit card number.

Referring to FIG. 5(*c*), in response to the user selecting a product to purchase and entering appropriate information (which may be configured in the client application to prevent entry for every purchase), QB 400 confirms the order by displaying a confirmation tab 408. The user can confirm the order or go back to the prior screen. If the user rejects the order by pressing a key on the user's STB 18 remote control defined by a button on the order confirmation tab 408, QB 400 redisplays quick buy tab 406. If the user confirms the order, QB 400 forwards the order to CTP 22 for processing. As discussed above, CTP 22 will forward the information to the CCP, which may handle the request, or which may forward the request to a separate vendor e-commerce system for processing.

Referring to FIG. 5(*d*), the system then displays a thank you tab 410, removes all tab screens from the video display, and can redisplay quick buy icon 402 if configured to do so or simply remove all non-programming information from the screen.

If the product selected requires additional configuration, such as quantity, style, size, etc., prior to purchase, QB 400 launches another client application referred to here as the electronic buying guide (EBG) 500 and passes the existing purchase parameters to the EBG. EBG 500 can also be launched from QB 400 via a button shown in FIG. 5(*b*) on quick buy tab 406, or can be launched in other ways including via an STB 18 remote control key defined and processed by the STB 18 resident application, and via the user tuning the STB 18 to a channel dedicated to the EBG 500.

When EBG 500 is launched, by whatever means, the STB 18 resident application responds by loading the EBG 500 executable file from the MSO's head end network file system (such as the Scientific Atlanta broadcast file system). Once loaded and running in the memory of the STB 18, EBG 500 displays a graphic screen configured, for example, as illustrated in FIG. 6(*a*). EBG 500 graphic screen may include at least one detail window 502, at least one video capture window 504, and at least one tab screen display window 506.

Referring to FIG. 6(*b*), detail window 502 provides additional detail about products that may be purchased, or for which more information can be displayed. Detail window 502 may include any of the following: a header 508, at least one graphics box 510, at least one text box 512 and at least one input box 514. Header 508 can contain text much like the text box described below. The graphics box 510 can display a picture in any one of a number of formats such as bitmap (.bmp), joint photographic experts group (JPEG), graphics interchange format (.gif), etc. Text box 512 can be configured to display text in various font styles and point sizes and may or may not include a scrolling feature for text of a length exceeding the size of the box. Input box 514 is a data entry field which can be populated by the user in several ways. For example, it can be populated by the user directly from STB 18 remote control numeric keys, or by a pull-down menu containing a predetermined number and type of data options from which the user can choose.

The detail window can be configured as desired to provide information about the product. Accordingly, the detail window may have text only, a photograph, a moving image, or a desired combination of text and graphics.

Referring again to FIG. 6(*a*), video capture window 504 displays video in any of a number of formats, such as MPEG or MPEG 2. The video being displayed can be captured from various sources, but it will most typically be captured from the tuned channel at the time the EBG was invoked.

Referring to FIGS. 6(*c*) and 6(*d*), tab screen display window 506 has at least one tab screen 600. When more than one tab is presented in tab screen display window 506, tab 602, screen detail 604, and button bar 606 of an active tab screen 516 are displayed, but only tab 602 of each inactive tab screen 518 is displayed. The user can switch from the active tab screen 516 to an adjacent inactive tab screen 518 by pressing a defined STB 18 remote control key such as the left and right arrow keys. In another embodiment, the user can switch from an active tab screen 516 to an inactive tab screen 518 by pressing the numeric key on STB 18 remote control that corresponds to a number assigned to a tab screen 600, which may be displayed on tab 602. When such user input occurs, the active tab screen 516 becomes an inactive tab screen 518, and the newly selected inactive tab screen 518 becomes the active tab screen 516.

Referring to FIG. 6(*d*), each tab screen 600 may include a tab 602, at least one section of screen detail 604, and at least one button bar 606. Tab 602, which generally functions to identify the tab screen 600, can display graphics or text in various font styles and point sizes.

Referring to FIG. 6(*e*), screen detail 604 within a tab screen can have several components. For example, a list 608 can include at least one header 610, at least one list box 612, at least one scroll bar 616, and a scroll bar indicator 618. As an alternative, a text component 620 can include at least one header 610, at least one text box 622, at least one input box 514 (see FIG. 6(*b*)), at least one scroll bar 616, and a scroll bar indicator 618. Header 610 can contain text much like text box 622 described below.

List box 612 contains at least one line item 614 and may be configured to display a fixed number of line items 614 at one time notwithstanding the number of items in the actual list to be displayed by list box 612. For example, if list box 612 is configured to display four line items 614, but the list to be displayed by list box 612 contains 10 items, the user can scroll upward or downward to cause list box 612 to display the items that are not currently displayed in list box 612. As the user scrolls through list box 612, the current line item may be highlighted and the scroll indicator 618 in scroll bar 616 is repositioned relative to the current line item content position in the actual list, where scroll bar 616 represents the length of actual list. Text box 622 can be configured to display text in various font styles and point sizes and may or may not include a scrolling feature as described above utilizing scroll bar 616 for text of a length exceeding the size of the box.

Referring to FIGS. 6(*b*) and 6(*f*), button bar 606 may include one or more buttons 624 and button text 626. Button text 626 can be configured to display text in various font styles and point sizes and is generally used to identify the function of an associated button 624; however, button text 626 can also be utilized in the absence of an associated button 624 to convey information to the user. A button 624 is a virtual representation of a defined input key on a STB 18 remote control. A button 624 may be displayed on the button bar 606 graphically or textually, or by a combination of the two. The client application 12, such as the QB 400 or the EBG 500, maps the button 624 to the corresponding STB remote control key by registering its interest in such a key with the STB operating system. For example, when the user selects the mapped key on the STB remote control, the STB operating system delivers the user input to client application 12, and client application 12 in turn calls the function associated with such input.

As explained above, EBG 500 interface can be configured using any combination of detail windows 502, video capture windows 504 and tab screen display windows 506, which can each in turn be configured using any combination of their respective components.

In a typical embodiment of EBG 500, the functionality available to the user at any given time is driven by the active tab screen 516. EBG functionality presented by a given active tab screen 516 determines the configuration of the EBG interface, including the location, number and configuration of detail windows 502 and video capture windows 504. Each of the components of the EBG 500 interface provides information to the user, receives information from the user, or both. A number of active tab screens can be included in EBG 500.

One of the screens within the EBG is a quick buy tab screen 600. The functionality of such a tab is similar to that of quick buy tab 406 described above in an embodiment of the QB application. In both instances, the key function of the quick buy tab screen is to display a list of products, preferably associated with the underlying programming being displayed on the tuned channel. When the quick buy tab screen is utilized in the EBG context, the tuned channel is captured in a video capture window 504 and a detail window 502, configured in accordance with the need for information about the product, is available to display real-time detailed product information about a given product as the user scrolls through the product list. When the user selects a product to purchase, the detail window 502 can then be utilized to display further information and request user input, such as quantity, style, color, size, etc., regarding the selected product. In another instance, a video capture window can be utilized to display video information regarding the selected product.

Another screen is a favorites tab screen. The favorites tab screen can have detail similar to that shown in FIG. 6(*e*) and can function identically to the quick buy tab screen described above, except that the user, rather than the underlying programming, determines the content of the product list. The user may add items to the favorites list by tagging any item the user so designates as a "favorite" while viewing any other product list provided by any client application at any time. The favorites tab screen also provides the user with the functionality to remove items from the favorites list. The favorites list is stored in the HEDS 14 for later retrieval as discussed in conjunction with FIG. 2, even after the client application has been closed and reopened. In other words, the storage is essentially permanent. The user can therefore delay purchase of a particular item, while the favorites list provides a convenient way to maintain the list for the user.

An order status tab screen displays a list of products recently ordered by the user and the status of each individual order. Each order listed can include a level of detail such as order date, product description and order status. In the preferred embodiment, an order's status can be Shipped, In Process, Pending, Back Ordered and Canceled. An order is "Shipped" when the vendor informs the commerce control network (CCN) that the product has in fact been shipped. An order is "In Process" when it is at a stage of processing at which the user cannot cancel the order. An order is "Pending" when it is at a stage of processing at which the user can cancel the order. An order is "Back Ordered" when the vendor informs the CCN that the vendor's inventory of such item is temporarily depleted. Back ordered orders are cancelable by the user. An order is "Canceled" when the vendor informs the CCN that the user's credit authorization has failed, the user cancels the order, or the vendor has sold out of a limited quantity item. The order status tab screen can display each status in an appropriate color such as green for "Shipped", red for "Canceled" and yellow for all other statuses. Orders with a status of "Shipped" are removed from the user's order status list after a fixed period of time lapses. The user can obtain more information about an individual order on the order status tab screen by selecting the order for review, at which time the EBG will display additional details about the order, such as order number, shipping method, tracking number, shipping address, etc.

A settings tab screen allows the user to configure certain features of the EBG. Such settings can include payment information, shipping method, interface color scheme, security features, etc. In addition, the settings tab screen provides a method for configuring more than one user per household. Each such user can have its own security code and user profile as described below.

A profiles tab screen allows the user, or users, to store default personal data, payment data and purchase preference data. Default personal data can include information such as clothing sizes, which the EBG can use to populate clothing size fields that would otherwise have to be populated by the user. Payment data can be user-specific credit card or other data that will override the default payment data set up for the household in the settings tab screen. Purchase preference data can include user-designated product cost maximums and minimums, preferred vendors and preferred product types. Preferred product types can range from broad categories such as books, music and clothing to narrow categories such as fiction, folk, and formal. The EBG can use an individual user's purchase preference data to customize product lists.

A help tab screen can offer context sensitive or general help. In another embodiment of the help function, context sensitive help can be provided via the detail or capture windows while the user is navigating through one or several of the other windows displayed in the EBG interface.

Figure 7:
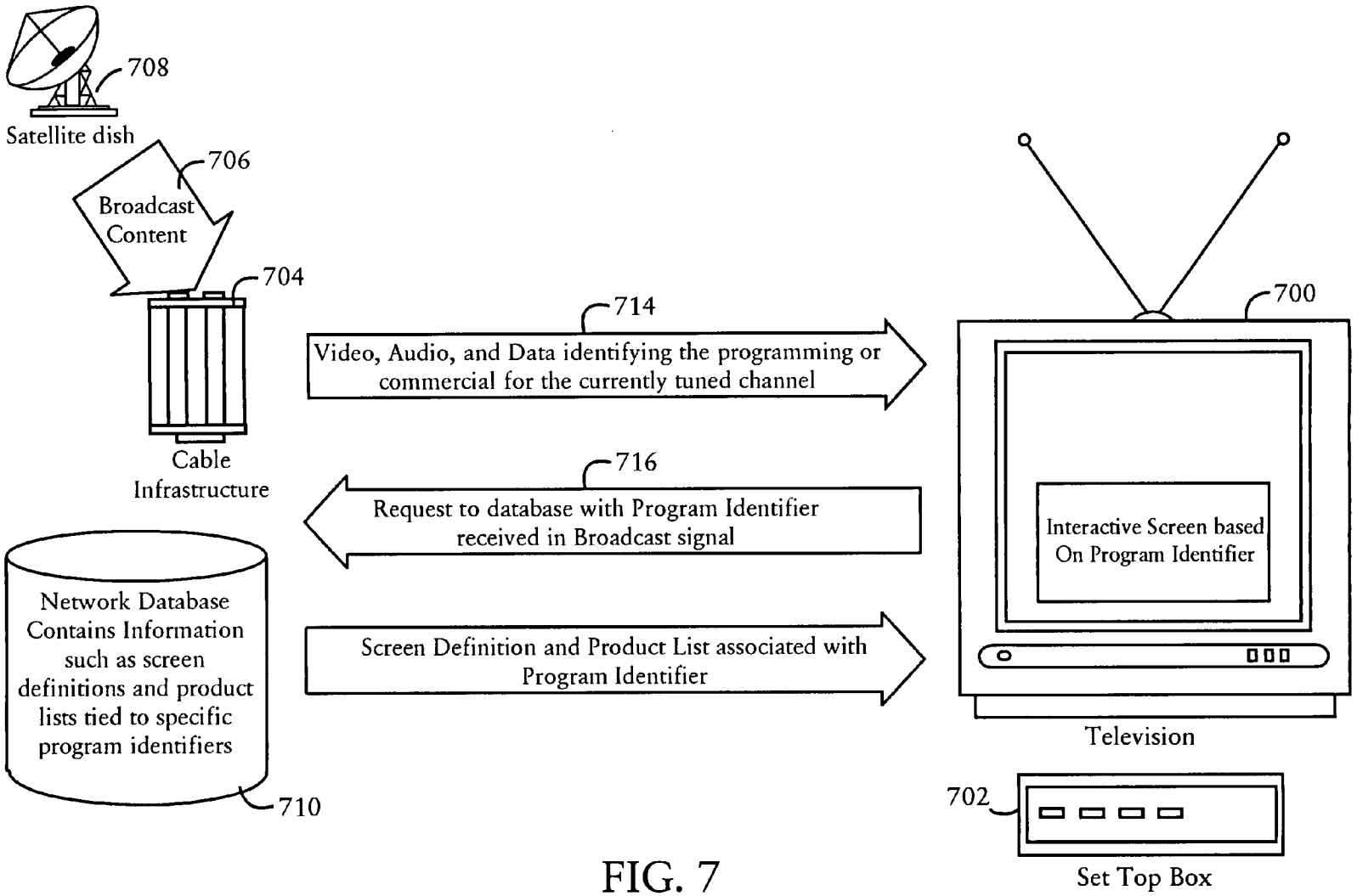
FIG. 7 is a block diagram of a system illustrating the use of a program identifier.

Referring to FIG. 7, a television set 700 with set top box 702 receives programming and data from a cable infrastructure 704. Infrastructure 704 received broadcast content 706 from a satellite 708, and is coupled to a network database 710 in a manner described above. The system can provide direct automated access to information in network database 710 using a unique program identifier embedded in a video or audio program, commercial message, or news story.

Cable infrastructure 704 provides video and audio, along with data identifying the programming or commercial for the currently tuned channel as indicated by arrow 714. Programs are received through broadcast, cable or prerecorded media, and can be encoded in either analog or digital formats. The unique program identifier can be encoded in a vertical blanking interval (VBI) or other non-displayed portion of an electronic signal which represents the video or audio program so as not to interfere with the program as displayed or transduced on a television or audio sound system. The unique identifier is detected and decoded from the electronic signal at the set top box 702.

The user can make a request for information, and the request will include the program identifier received in the broadcast signal, as indicated by arrow 716. The cable infrastructure then uses that program identifier to retrieve and broadcast screen definition and product lists associated with the program identifier. Upon detecting the unique program identifier, the system indicates to the user that more information is available via some screen notification mechanism. The user may then elect to retrieve the information from the network database by giving a simple command, e.g., pushing a special button on a remote control. The system then automatically sends a message to the network database and retrieves the data requested for display on the television. The display itself may be different based on the screen definition information associated with the particular program identifier in the network database. Based on the information received, the user can then interact with the system to purchase the products associated with the underlying content in the manner described above.

While a number of embodiments have been described, it should be apparent that modifications can be made without departing from the scope of the appended claims. For example, although the broadcast distribution network has been described mainly in terms of a digital broadcast distribution system, suitable for digital, high definition television broadcasting, the claimed invention is equally applicable to the analog television distribution networks that are still currently in place. Similarly, the present invention is as applicable to systems employing advanced analog set top boxes that support communications through an upstream data path, as it is to those containing digital set top boxes.

What is claimed is:

1. A broadcast system for distributing product data, comprising:

a broadcast station configured to broadcast information, including video programming and a plurality of program identifiers, each program identifier being uniquely associated with a segment of the video programming; and a plurality of user stations, each configured to receive the broadcast information and to transmit a first product related request including the one unique identifier corresponding to the programming segment to which the first product request relates;

wherein the broadcast station is further configured to receive the first product request, and, in response, to transmit to the user station from which the first product related request was received, first product data identified based on the one unique identifier included in the first product request;

wherein the broadcast station is further configured to broadcast the broadcast information, including the video programming and the plurality of program identifiers, in a signal, with each program identifier encoded in a portion of the signal that represents the segment of the video programming with which that program identifier uniquely corresponds.

2. A system according to claim 1, wherein the first product request relates to the programming segment being received by the user station at the time the first product request is transmitted.

3. A system according to claim 1, wherein the first product related request is transmitted in response to a first user input, and further comprising:

an input device configured to communicate the first user input to the user station.

4. A system according to claim 1, wherein the broadcast station is further configured to further transmit the received first product request, and further comprising:

a system server configured to receive the first product request, to retrieve the first product data from a database using the one unique identifier, and to transmit the first product data to the broadcast station.

5. A system according to claim 1, wherein the first product data includes a list identifying one or more products, and the user station is further configured to display the product list.

6. A system according to claim 5, wherein the first product data includes a screen display definition and the user station is further configured to display the product list in accordance with the screen display definition.

7. A system according to claim 6, wherein:

the first product data is one of a plurality of first product data, each corresponding to one of the plurality of unique identifiers, and each including one of a plurality of screen display definitions; and a second of the plurality of first product data includes a second of the plurality of screen display definitions that is different from the first of the plurality of screen display definitions.

8. A system according to claim 1 wherein the user station is further configured to display the first product data simultaneously with the video programming.

9. A system according to claim 1, wherein the user station is further configured to display, in response to receipt of the one unique identifier, notification of availability of the first product data.

10. A system according to claim 9, wherein the notification of availability is in the form of an icon displayed simultaneously with the video programming.

11. A system according to claim 1, wherein:

each of the plurality of user stations is further configured to transmit a second product request based on a second user input responsive to the received first product data; and the broadcast station is further configured to receive the second product request, and, in response, to transmit second product data to the user station.

12. A system according to claim 11, wherein the second product data is at least one of (i) product attribute information, and (ii) product purchase information.

13. A system according to claim 11, wherein the second product data is displayed simultaneously with the video programming.

14. A system according to claim 11, further comprising:

an input device configured to communicate the second user input to the user station.

15. A system according to claim 1, wherein the broadcast station is further configured to broadcast the plurality of unique identifiers via an in-band data path.

16. A system according to claim 1, wherein the video programming is broadcast in an analog format and the portion of the signal includes a vertical blanking interval, and the corresponding unique program identifier is broadcast in the vertical blanking interval.

17. A method according to claim 16, wherein the first product information includes a list identifying one or more products, and further comprising:

displaying the product list at the user station.

18. A method according to claim to 17, wherein the first product information includes a screen display definition, and further comprising:

displaying the product list at the user station in accordance with the screen display definition.

19. A method according to claim 18, wherein:

the first product data is one of a plurality of first product data, each corresponding to one of the plurality of unique identifiers, and each including one of a plurality of screen display definitions; and a second of the plurality of first product data includes a second of the plurality of screen display definitions that is different from the first of the plurality of screen display definitions.

20. A method of distributing product related data over a broadcast system, comprising:

broadcasting, over the broadcast system, information including video programming and a plurality of programming identifiers, each of the programming identifiers being uniquely associated with a segment of the video programming;

receiving, via the broadcast system, a first product request including the one unique identifier corresponding to the programming segment to which the first product request relates; and transmitting via the broadcast system, first product data identified based on the one unique identifier included in the first product request;

wherein the broadcast information is broadcast to a plurality of user stations, the first product request is received from one of the plurality of user stations, and the first product data is transmitted to the one user station from which the first product request was received;

wherein the broadcast information, including the video programming and the plurality of program identifiers, is broadcast in a signal, with each program identifier encoded in a portion of the signal that represents the segment of the video programming with which that program identifier is uniquely associated.

21. A method according to claim 20, wherein the first product request relates to the programming segment being received by the user station at the time the first product request is transmitted.

22. A method according to claim 20, wherein the first product data transmitted to the one user station is on a database, and further comprising:

retrieving the first product data from the database using the one unique identifier.

23. A method according to claim 20, further comprising:

displaying the first product data at the user station simultaneously with the video programming.

24. A method according to claim 20, further comprising:

displaying at the user station, in response to the one unique identifier, notification of availability of the first product data.

25. A method according to claim 24, wherein the notification is in the form of an icon displayed simultaneously with the video programming.

26. A method according to claim 20, further comprising:

receiving a second product request from the one user station in response to the first product data; and transmitting, in response, second product data to the user station.

27. A method according to claim 26, wherein the second product data is at least one of (i) product attribute information, and (ii) product purchase information.

28. A method according to claim 26, further comprising:

displaying the second product data at the user station simultaneously with the video programming.

29. A method according to claim 26, wherein the second product request is based on a second user input to the user station.

30. A method according to claim 20, wherein the first product request is based on a first user input to the user station.

31. A method according to claim 20, wherein the broadcasting of the plurality of unique identifiers is via an in-band data path.

32. A method according to claim 20, wherein the video programming is broadcast in an analog format and the portion of the signal includes a vertical blanking interval, and the associated unique identifier is broadcast in the vertical blanking interval.

33. A broadcast programming user station, comprising:

a tuner configured to tune to any one of multiple broadcast video channels to receive broadcast information, including video programming and a plurality of programming identifiers, each program identifier being uniquely associated with a segment of the video programming;

a display screen configured to display the video programming; and a processor configured to generate a product request including the one unique identifier corresponding to the programming segment to which the product request relates;

wherein the tuner is further configured to transmit the product request;

wherein the broadcast information, including the video programming and the plurality of program identifiers, is received in a signal, with each program identifier encoded in a portion of the signal that represents the segment of the video programming with which that program identifier is uniquely associated.

34. A user station according to claim 33, wherein the product request relates to the programming segment to which the tuner is tuned at the time the product request is transmitted.

35. A user station according to claim 33, wherein:

the processor is further configured to direct, upon receipt of the one unique identifier, simultaneous display of an icon with the video programming, the icon being indicative of availability of product information; and the display screen is further configured to display, in accordance with the direction of the processor, the icon simultaneously with the display of the video programming.

36. A user station according to claim 33, wherein the processor is further configured to generate the product request in response to a user input, and further comprising:

an input device configured to communicate the user input to the processor.

37. A user station according to claim 36, wherein the input device is a television remote control.

38. A user station according to claim to 33, wherein:

the tuner is further configured to receive product data identified based on the one unique identifier included in the product request, the product data having been transmitted to the user station in response to the product request;

the processor is further configured to process the received product data and to direct a simultaneous display of the received product data with the video programming; and the display screen is further configured, in accordance with the direction of the processor, to simultaneously display the received product data with the video programming.

39. A user station according to claim 38, wherein the product data includes a listing identifying one or more products.

40. A user station according to claim 38, wherein the product data includes at least one of (i) product attribute information, and (ii) product purchase information.

41. A user station according to claim 38, wherein the product related information is received via one of an in-band path and an out-of-band data path.

42. A user station according to claim 38, wherein the processor is further configured to direct the simultaneous display of the received product data with the video programming, based on a user input, and further comprising:

an input device configured to communicate the user input to the processor.

43. A user station according to claim 42, wherein the input device is a television remote control.

44. A user station according to claim 38, wherein the product data includes a screen display definition and the processor is further configured to display the product data in accordance with the screen display definition.

45. A user station according to claim 33, wherein the plurality of program identifiers is received via an in-band data path.

46. A user station according to claim 33, wherein the received broadcast video programming is in an analog format and the portion of the signal includes a vertical blanking interval, and the associated unique identifier is broadcast in the vertical blanking interval.

47. A user station according to claim 33, wherein the tuner and the processor are housed in a television set top box.

* * * * *